US007439930B2

(12) United States Patent
Bury

(10) Patent No.: US 7,439,930 B2
(45) Date of Patent: Oct. 21, 2008

(54) ANTENNA MOUNT WITH FINE ADJUSTMENT CAM

(75) Inventor: Simon Bury, Wilpshire (GB)

(73) Assignee: ASC Signal Corporation, Garner, NC (US)

( * ) Notice: Subject to any disclaimer, the term of this patent is extended or adjusted under 35 U.S.C. 154(b) by 664 days.

(21) Appl. No.: 10/907,163

(22) Filed: Mar. 23, 2005

(65) Prior Publication Data

US 2006/0214865 A1 Sep. 28, 2006

(51) Int. Cl.
*H01Q 1/12* (2006.01)

(52) U.S. Cl. ..... 343/878; 343/882; 343/892

(58) Field of Classification Search ..... 343/878, 343/880, 882, 890, 892
See application file for complete search history.

(56) References Cited

U.S. PATENT DOCUMENTS

| | | | | |
|---|---|---|---|---|
| 4,251,819 | A | 2/1981 | Vickland | |
| 4,404,565 | A | 9/1983 | Gurney et al. | |
| 4,652,890 | A | 3/1987 | Crean | |
| 4,692,771 | A | 9/1987 | Rothbarth et al. | |
| 4,819,006 | A | 4/1989 | Whitesides et al. | |
| 4,819,007 | A | 4/1989 | Tezcan | |
| 4,924,239 | A | 5/1990 | Ceklovsky | |
| 4,980,697 | A | 12/1990 | Eklund | |
| 4,994,816 | A | 2/1991 | Kondo | |
| 5,000,408 | A | 3/1991 | Bourgeois et al. | |
| 5,402,140 | A | 3/1995 | Rodeffer | |
| 5,657,031 | A | 8/1997 | Anderson et al. | |
| 5,760,748 | A * | 6/1998 | Beckingham | 343/765 |
| 5,929,817 | A | 7/1999 | Clark | |
| 5,933,123 | A | 8/1999 | Kaul | |
| 5,982,333 | A | 11/1999 | Stillinger et al. | |
| 5,999,139 | A | 12/1999 | Benjamin et al. | |
| 6,188,372 | B1 * | 2/2001 | Jackson et al. | 343/882 |
| 6,208,317 | B1 | 3/2001 | Taylor et al. | |
| 6,211,845 | B1 | 4/2001 | Cook et al. | |
| 6,225,962 | B1 * | 5/2001 | Blanchard et al. | 343/880 |
| 6,342,870 | B1 | 1/2002 | Mehrkens et al. | |

(Continued)

FOREIGN PATENT DOCUMENTS

| | | |
|---|---|---|
| JP | 5817012 | 10/1983 |
| WO | 9941802 | 8/1999 |
| WO | 0017955 | 3/2000 |

*Primary Examiner*—Tan Ho
(74) *Attorney, Agent, or Firm*—Babcock IP, PLLC

(57) ABSTRACT

An antenna mount having a bracket with a projecting first cam mount and a pivot connection hole formed in a mounting surface. A base bracket having a base portion with a first cam slot and a pivot bolt hole adapted to align with the first cam mount and the pivot connection hole, respectively. A first fastener coupling the base bracket to the mounting surface between the pivot connection hole and the pivot bolt hole, the first cam mount projecting through the first cam slot. A cam with an eccentric mounting hole adapted to fit upon the first cam mount. The first cam rotatable about the first cam mount pivoting the base bracket about the pivot connection hole as a contact edge of the first cam abuts at least one first cam guide(s) of the base bracket. Further, the antenna mount may include a second cam and associated pivot arrangements to provide a second axis of adjustment.

19 Claims, 7 Drawing Sheets

U.S. PATENT DOCUMENTS

| | | | | |
|---|---|---|---|---|
| 6,404,400 | B1 | 6/2002 | Tulloch | |
| 6,445,361 | B2 | 9/2002 | Liu et al. | |
| 6,462,718 | B1 | 10/2002 | Ehrenberg et al. | |
| 6,507,325 | B2 | 1/2003 | Matz et al. | |
| 6,657,598 | B2 | 12/2003 | Tulloch | |
| 7,046,210 | B1 * | 5/2006 | Brooker et al. | 343/880 |
| 2004/0169114 | A1 | 9/2004 | Dierkes | |
| 2004/0222931 | A1 | 11/2004 | Matz et al. | |

* cited by examiner

ANTENNA MOUNT WITH FINE ADJUSTMENT CAM

BACKGROUND

For optimal performance, a directional antenna such as a reflector antenna must be closely aligned with a target signal source. Alignment of a reflector antenna is typically performed via an adjustable antenna mount that, with respect to a fixed mounting point, is adjustable in azimuth and elevation to orient the antenna towards the target.

Antenna mount coarse adjustment may be cost effectively incorporated into an antenna mount via a movable connection coupled to a fixed point, for example via one or more slot(s) and or a pivot point and a slot along which the pivot angle of the movable connection may be fixed by tightening one or more bolt(s) or the like. Fine adjustments are difficult to make in these arrangements because the targeting resolution along the slot(s) is very low due to the free movement of the movable connection until the bolt(s) are tightened. Further, the selected rough adjustment tends to move slightly as the bolt(s) are finally tightened.

Where multiple feeds are applied to a single reflector to simultaneously receive closely spaced beams from different satellites, precision alignment is critical to achieve acceptable signal performance with respect to each of the satellites. High resolution adjustment capability may also be used for a single feed reflector and or terrestrial applications where precision alignment is desired.

The adjustable antenna mount must be designed to support the entire antenna mass and also withstand any expected environmental factors such as wind shear and or ice loading. However, adjustable antenna mounts that are both sufficiently strong and easily adjustable with precision significantly increase the cost of the resulting antenna.

The increasing competition for reflector antennas adapted for high volume consumer applications such as data, VSAT, satellite tv and or internet communications has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

The invention will be described with reference to an exemplary embodiment of an antenna mount 2 according to the invention, as shown in FIGS. 1-8*c*. A primary bracket, for example, a clamp bracket 4 and a movable bracket 6 are coupled to a base bracket 8.

Figure 1:
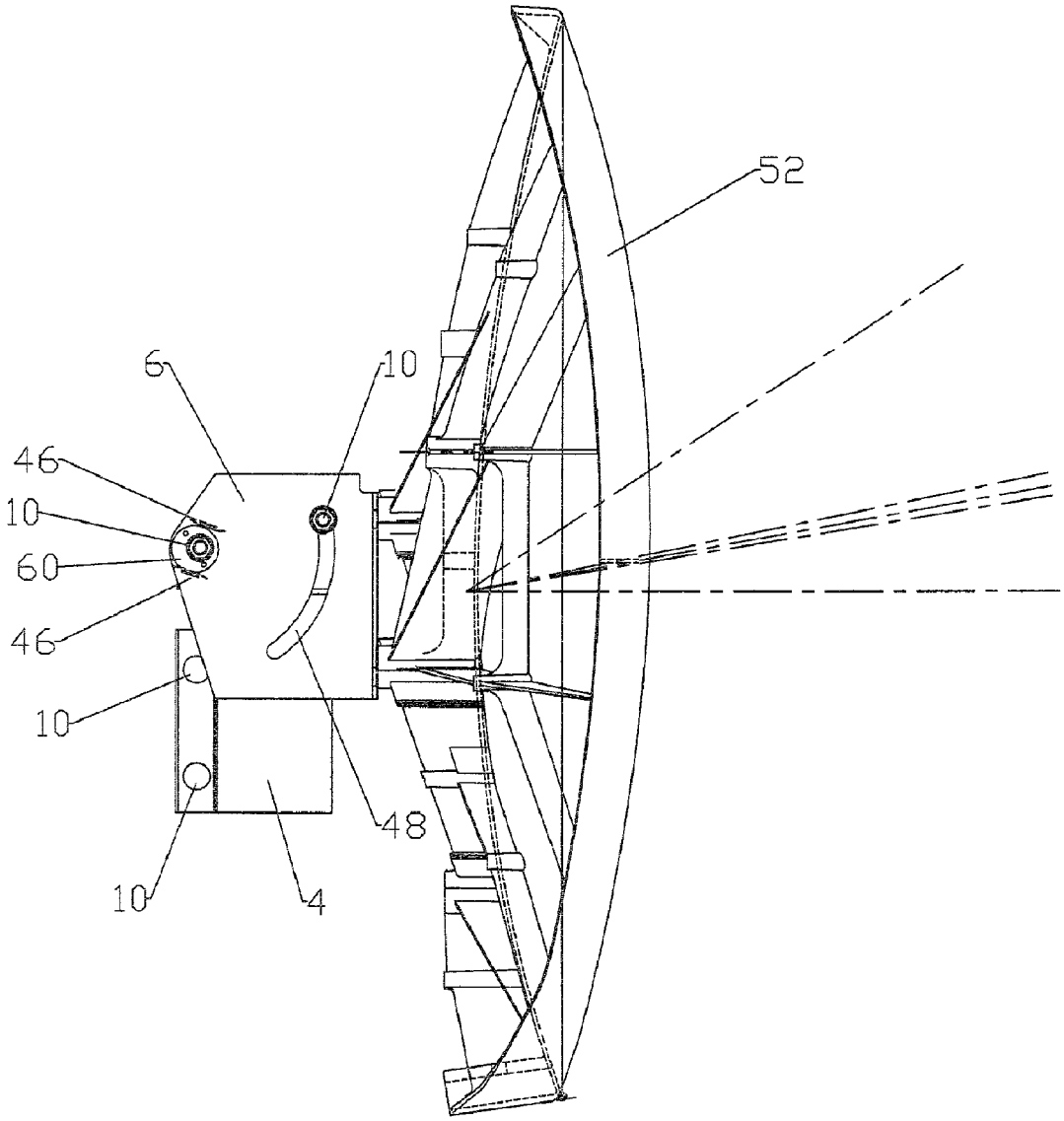
FIG. 1 is a schematic side view of an exemplary embodiment of the invention, arranged with respect to a main reflector to demonstrate elevation rough and fine adjustment ranges. The boom arm and LNB typically associated with the main reflector have been omitted for clarity.
Figure 2:
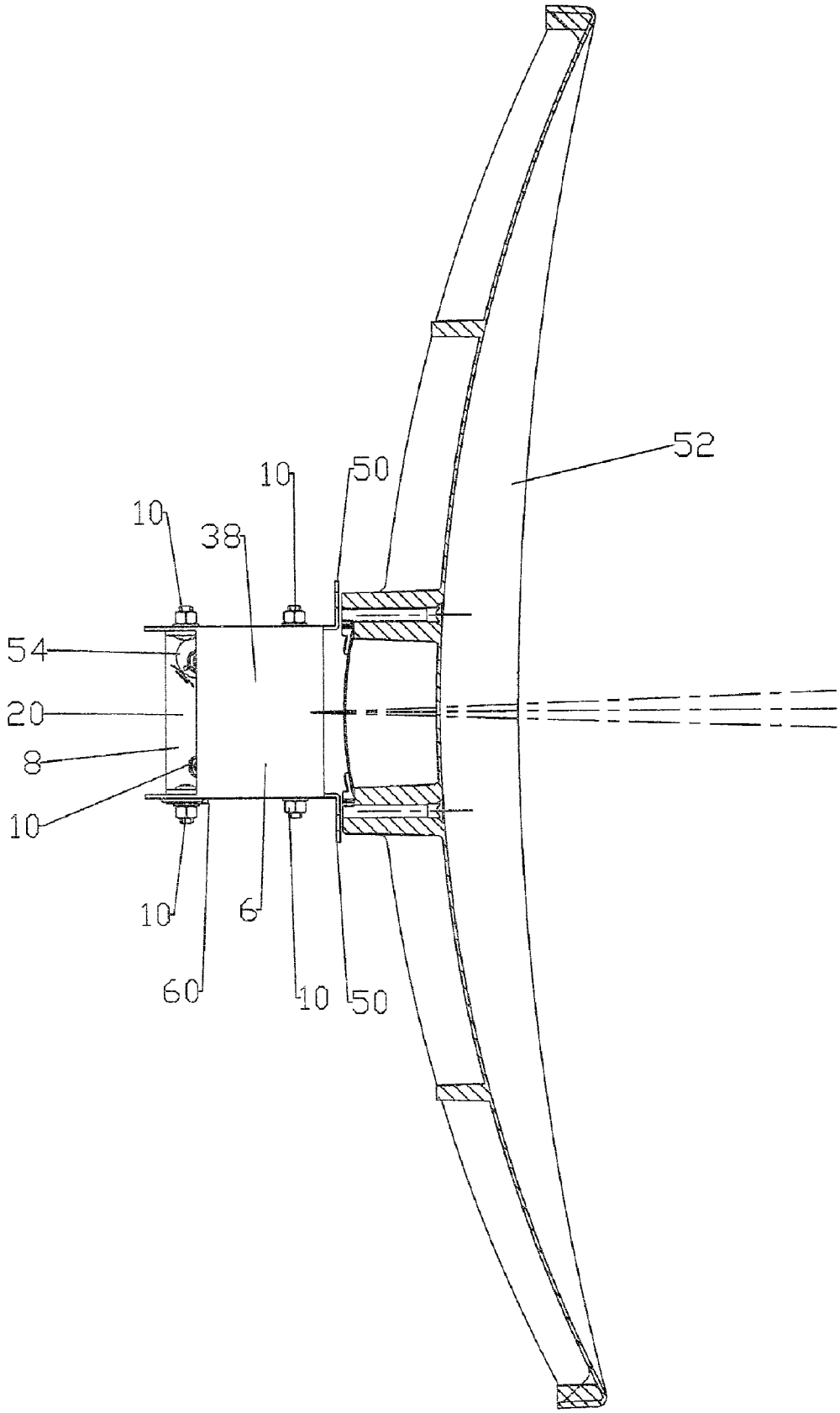
FIG. 2 is a schematic top view of FIG. 1, the main reflector shown in section, demonstrating fine azimuth adjustment range.
Figure 3:
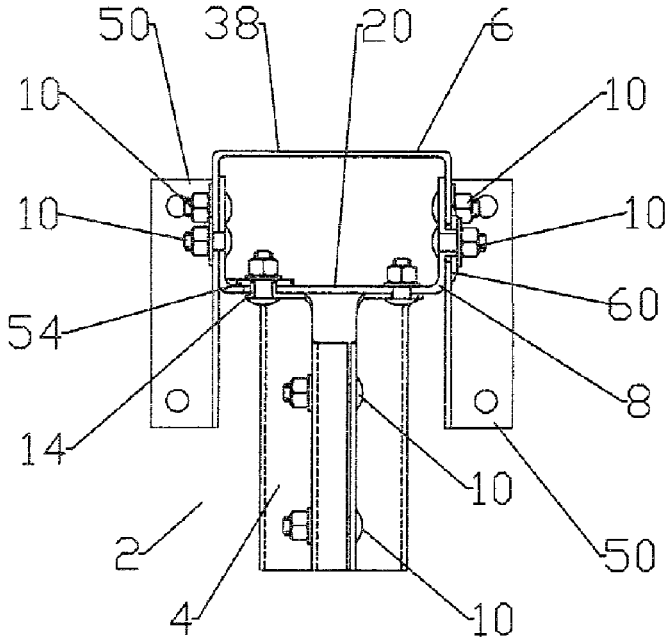
FIG. 3 is a schematic back view of FIG. 1, main reflector omitted and hidden lines along a section at the first horizontal axis shown for clarity.
Figure 4:
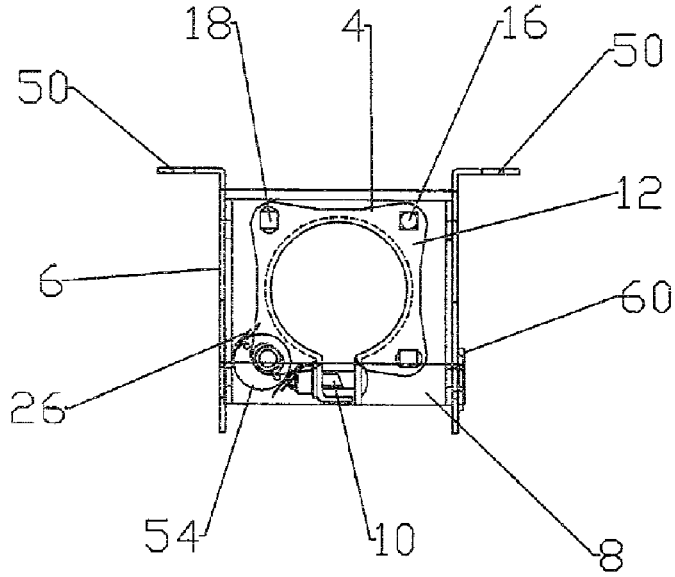
FIG. 4 is a schematic top view of FIG. 3, fastener(s) omitted, portions of the movable bracket and base bracket transparent for clarity.
Figure 5A:
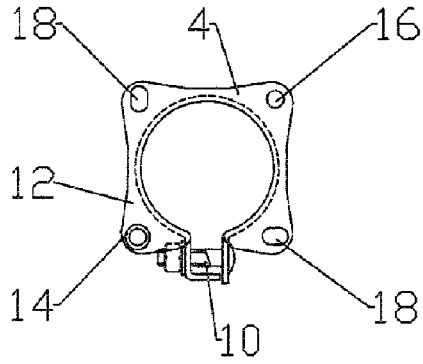
FIG. 5*a* is a schematic top view of the clamp bracket of FIG. 1.
Figure 5B:
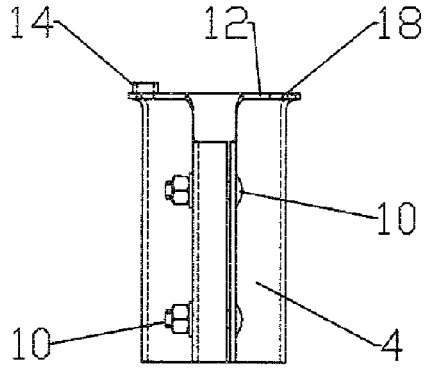
FIG. 5*b* is a schematic back view of the clamp bracket of FIG. 1.
Figure 5C:
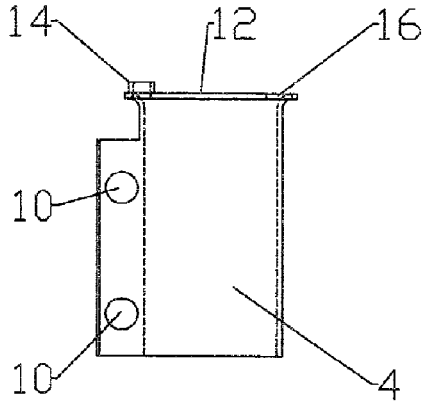
FIG. 5*c* is a schematic side view of the clamp bracket of FIG. 1.

As shown in FIGS. 5*a*-*c*, the clamp bracket 4 is adapted to encircle a cylindrical mount point such as a mounting pole, not shown, securely clamping the pole via a fastener 10 such as one or more nut and bolt connection(s). A mounting surface 12 at the top of the clamp bracket 4 has a raised first cam mount 14, a pivot connection hole 16 and a pair of adjustable connection hole(s) 18 adapted to receive the base bracket 8.

Figure 6A:
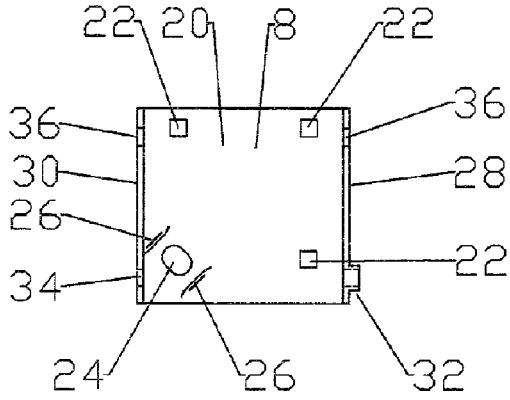
FIG. 6*a* is a schematic top view of the base bracket of FIG. 1.
Figure 6B:
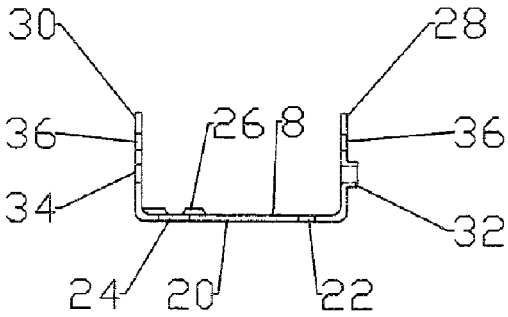
FIG. 6*b* is a schematic back view of the base bracket of FIG. 1.
Figure 6C:
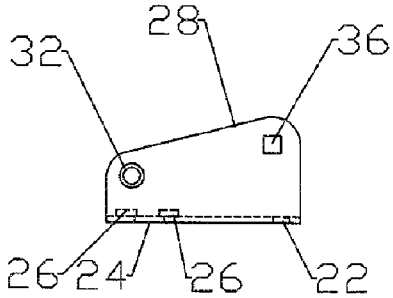
FIG. 6*c* is a schematic side view of the base bracket of FIG. 1.

The base bracket 8, as shown in FIGS. 6*a*-*c* has a base portion 20 with a plurality of bolt hole(s) 22 arranged to align with the pivot connection hole 16 and adjustable connection hole(s) 18 and a first cam slot 24 adapted to receive the first cam mount 14. A pair of first cam guide(s) 26 are positioned proximate the first cam slot 24. First and second end portion(s) 28, 30 are formed on either side of the base portion 20, oriented at 90 degrees to the base portion 20. A second cam mount 32 is formed in the first end portion 28. A corresponding first mount bolt hole 34 coaxial along a first horizontal axis normal to the first end portion 28 at the second cam mount 32 is formed in the second end portion 30. A pair of pivot hole(s) 36 also coaxial along a second horizontal axis normal to the first end portion 28 are formed in the first and second end portions 28, 30, spaced away from the first horizontal axis.

Figure 7A:
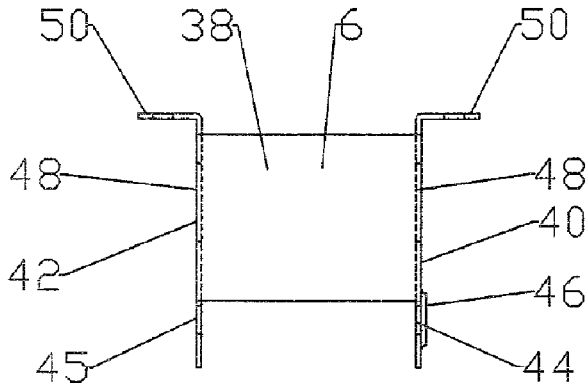
FIG. 7*a* is a schematic top view of the movable bracket of FIG. 1.
Figure 7B:
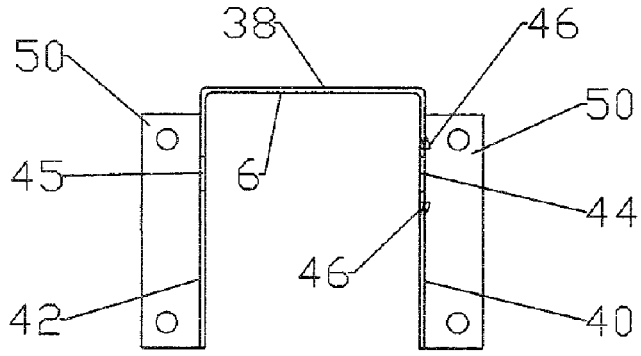
FIG. 7*b* is a schematic front view of the movable bracket of FIG. 1.
Figure 7C:
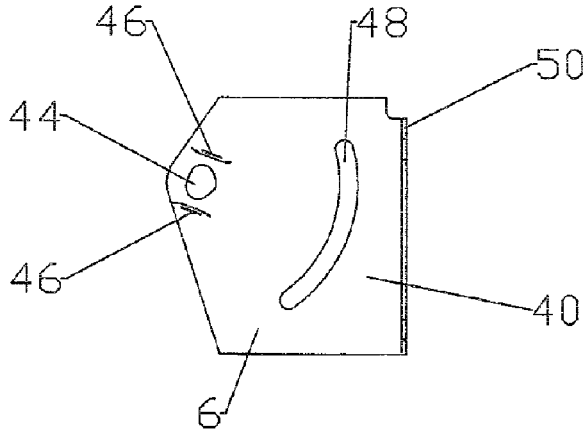
FIG. 7*c* is a schematic side view of the movable bracket of FIG. 1.

The movable bracket 6, as shown in FIGS. 7*a*-*c*, has a central portion 38, and third and fourth end portions 40, 42, oriented at 90 degrees to the central portion 38. The movable bracket 6 and the fixed bracket 8 are adapted to couple via interconnections between the first and third end portions 28, 40 and the second and forth end portions 30, 42, respectively. A second cam slot 44 in the third end portion and a second mount bolt hole 45 in the forth end portion are coaxial with the first horizontal axis of the fixed bracket 8. A second cam guide(s) 46 are positioned proximate the second cam slot 44. Angular slot(s) 48 having a radius of curvature generally normal to and centered upon the first horizontal axis are also formed in the third and fourth portions 40, 42 positioned to align with the second horizontal axis as the movable bracket 6 is pivoted about the first horizontal axis. Mounting flange(s) 50 with bolt holes formed at corresponding edges of the third and fourth portions may be used to secure the main reflector 52 or other connection point of the reflector antenna to the movable bracket 6.

Figure 8A:
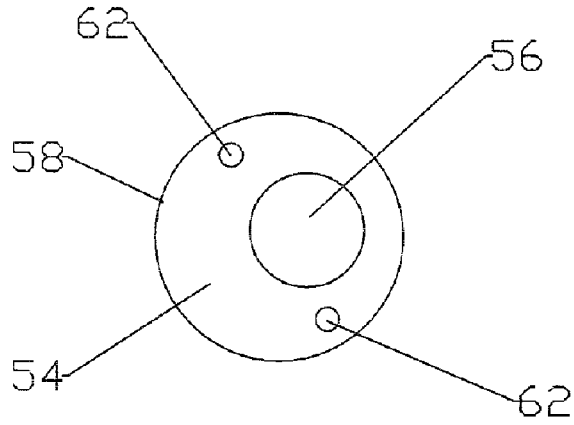
FIG. 8*a* is a schematic front view of a cam.
Figure 8B:
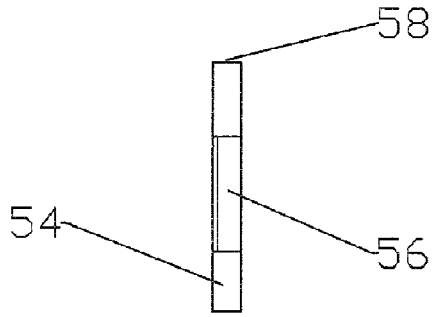
FIG. 8*b* is a schematic end section view of the cam of FIG. 8*a*.
Figure 8C:
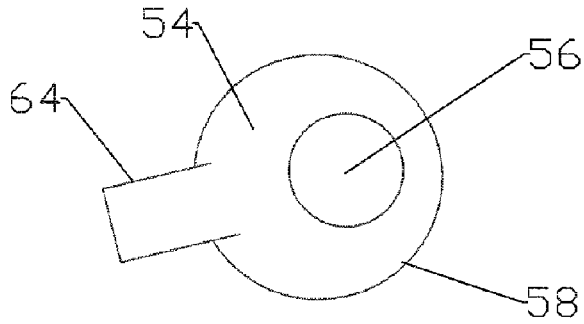
FIG. 8*c* is a schematic front view of a cam with a tang.

A first cam 54 with a mounting hole 56 eccentric to a contact edge 58 of the first cam 54, as shown for example in FIGS. 8*a-c*, is placed over the first cam mount 14 against the base portion 20, the contact edge 58 of the first cam 54 abutting the first cam guide(s) 26. A fastener 10 such as a nut and bolt or the like may be applied through the first cam mount 14 to retain the first cam 54 upon the first cam mount 14 and also retain the base bracket 8 upon the mounting surface 12. Similarly, a second cam 60 with a mounting hole 56 eccentric to a contact edge 58 of the second cam 58 is placed over the second cam mount 32 against the third end portion 40, between the second cam guide(s) 46. A fastener 10 such as a nut and bolt or the like may be applied through the second cam mount 32 to retain the second cam 58 upon the second cam mount 32 and also retain the movable bracket 6 upon the first end portion 28.

Rough azimuth alignment of the antenna mount 2 is performed by rotation of the clamp bracket 4 about the mounting pole, prior to final tightening of the related fastener(s) 10. With a fastener 10 such as a nut and bolt or the like applied to the pivot connection hole 16 and corresponding base bracket mounting hole 22, rotation of the first cam 54 between the first cam guide(s) 26 operates to pivot the base bracket 8 about the pivot connection hole 16 to apply a range of fine azimuth adjustment to the orientation of the main reflector.

Rough elevation alignment of the antenna mount 2 is performed by pivoting the movable bracket 6 with respect to the fixed bracket 8, about the first horizontal axis. With a rough elevation alignment selected, the angular slot 48 fastener 10 connections between the movable bracket 6 and the fixed bracket 8 at the second horizontal axis are tightened, creating a pivot point between the movable bracket 6 and the base bracket 8 along the second horizontal axis. Fine elevation adjustment may then be applied by rotation of the second cam 60 between the second cam guide(s) 46, pivoting the movable bracket 6 with respect to the base bracket 8 about the second horizontal axis.

To facilitate easy operator adjustment of the first and or second cam 54, 60, the cams may be adapted to include c-spanner hole(s) 62 and or an wrench tang 64 dimensioned for a desired wrench size, as shown in FIGS. 8*b* and 8*c*, respectively. When finally adjusted, the associated fastener 10 interconnections may be tightened to secure the selected antenna alignment.

The range and resolution of fine adjustment resulting from rotation of the first and second cams 54, 58 is a function of four factors: the selected cam diameter; the displacement of the mounting hole from the center of the cam; and the distance between the cam mount and the pivot point, i.e. between the first horizontal axis and the second horizontal axis with respect to the second cam. Associated adjustment connection holes and cam slots are dimensioned to allow for the desired range of adjustment. Response to cam adjustment and or change of direction slop in the mechanism is dependent upon the tolerances applied to the fit of the cam upon the respective cam mount and of the cam between the cam guides.

One skilled in the art will appreciate that the main components of the invention may be cost effectively fabricated by metal stamping. Alternatively, die casting and or injection molding may be applied. The specific exemplary embodiment of the invention described herein in detail is demonstrated with respect to a vertical pole mounting but may alternatively be readily adapted to a particular desired mounting surface and or mounting surface orientation. While the present invention has been demonstrated with mating u-brackets, equivalent pivoting structures may be formed by mating angle or T-brackets having sufficient materials strength to withstand the expected weight and environmental stresses upon the antenna mount. Further, the reflector antenna interconnection with the movable bracket may be adapted as desired, including incorporation of the movable bracket into the structure of the main reflector.

The present invention provides an antenna mount with precision adjustment capability having significantly reduced complexity and manufacturing precision requirements, resulting in a significant reduction in overall cost. Also, the time required for installation and configuration of a reflector antenna incorporating an antenna mount according to the invention is similarly reduced.

Table of Parts

| | |
|---|---|
| 2 | antenna mount |
| 4 | clamp bracket |
| 6 | movable bracket |
| 8 | base bracket |
| 10 | fastener |
| 12 | mounting surface |
| 14 | first cam mount |
| 16 | pivot connection hole |
| 18 | adjustable connection hole |
| 20 | base portion |
| 22 | bolt hole |
| 24 | first cam slot |
| 26 | first cam guide |
| 28 | first end portion |
| 30 | second end portion |
| 32 | second cam mount |
| 34 | mount bolt hole |
| 36 | pivot hole |
| 38 | central portion |
| 40 | third end portion |
| 42 | forth end protion |
| 44 | second cam slot |
| 45 | second mount bolt hole |
| 46 | second cam guide |
| 48 | angular slot |
| 50 | mounting flange |
| 52 | main reflector |
| 54 | first cam |
| 56 | mounting hole |
| 58 | contact edge |
| 60 | second cam |
| 62 | c-spanner hole |
| 64 | wrench tang |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An antenna mount, comprising:

a primary bracket having a mounting surface with a projecting first cam mount and a pivot connection hole;

a base bracket having base portion with a first cam slot and a pivot bolt hole adapted to align with the first cam mount and the pivot connection hole, respectively;

a first fastener coupling the base bracket to the coupling surface between the pivot connection hole and the pivot bolt hole, the first cam mount projecting through the first cam slot;

a first cam with a first eccentric mounting hole mounted upon the first cam mount;

the first cam rotatable about the first cam mount pivoting the base bracket about the pivot connection hole as a contact edge of the first cam abuts at least one first cam guide(s) of the base bracket.

2. The antenna mount of claim 1, further including a second fastener passing through the first cam mount to couple the primary bracket, base bracket and first cam together.

3. The antenna mount of claim 1, wherein the primary bracket is a clamp bracket adapted to clamp around a cylindrical mount point.

4. The antenna mount of claim 1, further including a first end portion normal to the base portion and a movable bracket having a third end portion;

the first end portion having a projecting second cam mount and a pivot hole;

the third end portion having a second cam slot and an angular slot having a radius of curvature generally centered upon the second cam slot;

the first end portion and the third end portion adapted to mate whereby the second cam mount projects through the second cam slot and an angular slot fastener couples the first end portion and the third end portion together via the pivot hole and the angular slot; and a second cam with a second eccentric mounting hole mounted upon the second cam mount;

the second cam rotatable about the second cam mount pivoting the third end portion about the pivot hole as a contact edge of the second cam abuts at least one second cam guide(s) of the third end portion.

5. The antenna mount of claim 4, wherein the base bracket and the movable bracket are u-shaped; the base bracket having a second end portion projecting from the base portion and the movable bracket having a fourth end portion projecting from the central portion; the second end portion and the fourth end portion coupled along a first horizontal axis passing through the second cam mount and along a second horizontal axis passing through the pivot hole; the first and second horizontal axis both normal to the first end portion.

6. The antenna mount of claim 4, further including a mounting flange projecting from and normal to the third end portion.

7. The antenna mount of claim 1, wherein the first cam has a pair of c-spanner holes.

8. The antenna mount of claim 1, wherein the first cam has an end tang adapted for a wrench.

9. The antenna mount of claim 1, further including at least one adjustable connection hole in the mounting surface aligned with a bolt hole of the base portion; the adjustable connection hole and the bolt hole coupled by a third fastener.

10. An antenna mount, comprising:

a first end portion and a third end portion;

the first end portion having a projecting second cam mount and a pivot hole;

the third end portion having a second cam slot and an angular slot having a radius of curvature generally centered upon the second cam slot;

the first end portion and the third end portion adapted to mate whereby the second cam mount projects through the second cam slot and an angular slot fastener couples the first end portion and the third end portion together via the pivot hole and the angular slot; and a second cam with a second eccentric mounting hole mounted upon the second cam mount;

the second cam rotatable about the second cam mount pivoting the third end portion about the pivot hole as a contact edge of the second cam abuts at least one second cam guide(s) of the third end portion.

11. The antenna mount of claim 10, wherein the first end portion is normal to a base portion between the first end portion and a second end portion also normal to the base portion;

the third end portion is normal to a central portion between the third end portion and a forth end portion also normal to the central portion;

the second end portion and the fourth end portion coupled along a first horizontal axis passing through the second cam mount;

the second end portion and the forth end portion also coupled along a second horizontal axis passing through the pivot hole; the first horizontal axis and the second horizontal axis both normal to the first end portion.

12. The antenna mount of claim 11, wherein the base portion has a first cam slot and a pivot bolt hole adapted to align with a mounting surface of a primary bracket having a projecting first cam mount and a pivot connection hole adapted to align with the first cam slot and the pivot bolt hole, respectively;

a first fastener coupling the base bracket to the primary bracket between the pivot connection hole and the pivot bolt hole, the first cam mount projecting through the first cam slot; and a first cam with a first eccentric mounting hole mounted upon the first cam mount;

the first cam rotatable about the first cam mount pivoting the base bracket about the pivot connection hole as a contact edge of the first cam abuts at least one first cam guide(s) of the base bracket.

13. The antenna mount of claim 10, further including a mounting flange projecting from and normal to the third end portion.

14. The antenna mount of claim 10, wherein one of the third end portion and the first end portion is coupled to a reflector antenna.

15. An antenna mount comprising:

a primary bracket and a base bracket;

the primary bracket pivotably coupled to the base bracket via a first fastener;

a first cam having an eccentric mounting hole rotatably mounted to the primary bracket operable to pivot the base bracket about the first fastener as the first cam is rotated and a contact edge of the first cam abuts at least one first cam guide(s) of the base bracket; and a movable bracket;

the movable bracket pivotably coupled to the base bracket via a second fastener;

a second cam having an eccentric mounting hole rotatably mounted to the base bracket operable to pivot the movable bracket about the second fastener as the second cam is rotated and a contact edge of the second cam abuts at least one second cam guide(s) of the movable bracket.

16. The antenna mount of claim 15, wherein the second fastener couples to the movable bracket along the extents of an angular slot of the movable bracket having a radius of curvature generally centered upon the eccentric mounting hole of the second cam.

17. The antenna mount of claim 15, wherein the primary base bracket pivots with respect to an antenna elevation alignment and the movable bracket pivots with respect to an antenna azimuth alignment.

18. The antenna mount of claim 15, wherein the base bracket and the movable bracket are u-shaped.

19. The antenna mount of claim 15, wherein the movable bracket is coupled to a reflector antenna.

* * * * *